US008439768B1

(12) United States Patent
Shah

(10) Patent No.: US 8,439,768 B1
(45) Date of Patent: May 14, 2013

(54) TOOL WITH HOLDER FOR SMOKING ARTICLE

(76) Inventor: Sarmad Shah, Louisville, KY (US)

( * ) Notice: Subject to any disclaimer, the term of this patent is extended or adjusted under 35 U.S.C. 154(b) by 299 days.

(21) Appl. No.: 13/013,493

(22) Filed: Jan. 25, 2011

(51) Int. Cl.
*A63B 55/10* (2006.01)

(52) U.S. Cl.
USPC ..... 473/282; 473/408; 131/257; 211/70.2

(58) Field of Classification Search ..... 473/282, 473/286, 408; D21/796, 793; D6/552; 211/70.2; 131/257, 259
See application file for complete search history.

(56) References Cited

U.S. PATENT DOCUMENTS

| | | | | |
|---|---|---|---|---|
| 4,627,621 | A * | 12/1986 | Tate | 473/286 |
| 5,116,046 | A | 5/1992 | Pace | |
| 5,226,647 | A | 7/1993 | Notarmuzi | |
| 5,305,999 | A | 4/1994 | Tate | |
| 5,437,449 | A | 8/1995 | Zink | |
| 5,730,404 | A * | 3/1998 | Evans et al. | 248/156 |
| 5,788,197 | A * | 8/1998 | Tutela | 248/156 |
| 5,813,414 | A * | 9/1998 | Zutler et al. | 131/241 |
| 5,819,750 | A | 10/1998 | Moyer | |
| 5,868,143 | A * | 2/1999 | Nielsen | 131/329 |
| 6,022,280 | A | 2/2000 | Arenburg et al. | |
| 6,234,916 | B1 | 5/2001 | Carusillo et al. | |
| 6,290,617 | B1 | 9/2001 | Cole et al. | |
| 7,841,951 | B1 * | 11/2010 | Schiltz | 473/282 |
| 8,206,236 | B1 * | 6/2012 | Neu | 473/282 |
| 2002/0132679 | A1 * | 9/2002 | Wilde et al. | 473/282 |
| 2006/0070634 | A1 | 4/2006 | Brunkow | |
| 2007/0202960 | A1 * | 8/2007 | Flanagan | 473/282 |
| 2007/0219014 | A1 * | 9/2007 | Merriman | 473/286 |
| 2012/0065002 | A1 * | 3/2012 | Cameron | 473/408 |

* cited by examiner

*Primary Examiner* — Stephen L. Blau
(74) *Attorney, Agent, or Firm* — Middleton Reutlinger; James E. Cole

(57) ABSTRACT

A golf tool comprises a body having an upper portion and a lower portion, an outwardly facing surface and an inwardly facing surface, at least first and second prongs depending from the body for repairing a golf ball pitch-mark, an s-shaped serpentine structure extending from the upper portion of the body, the serpentine structure having a first end connected with and generally in vertical alignment with the body and a second end connected to a multi-purpose holder, the second end being offset from the body, the serpentine structure having a segment opposite the body defining a clip for clipping the golf tool to a golf bag, the multi-purpose holder having a shaft holder which is generally U-shaped and vertical in orientation, the multi-purpose holder separated from the body by the s-shaped serpentine structure, a channel having an axis which is generally horizontal and transverse to the shaft holder, wherein the golf tool is capable of a first position clipped to the golf bag and a golf shaft held in vertical orientation with the shaft holder, and a second position wherein the at least first and second prongs are positioned in the ground and a smoking article or golf club shaft is positioned in the channel to elevate from the ground.

20 Claims, 7 Drawing Sheets

TOOL WITH HOLDER FOR SMOKING ARTICLE

CROSS-REFERENCE TO RELATED APPLICATION

None.

TECHNICAL FIELD

The invention relates to a golf tool. More particularly, the golf tool is adapted for use in both retaining a putter on an outside of a golf bag and also retaining a smoking article during the course of play of golf or other sporting activity.

BACKGROUND OF THE INVENTION

Various amateur and professional athletes enjoy smoking while participating in a sporting activity such as, for instance, golf. For example, some "athletes" are well known for smoking on the golf course, for example Joe Pesci and John Daly.

Regardless of the known risks of smoking, some golfers prefer that when smoking during a round, and when one's turn arrives to strike a golf ball, the smoking article not be placed on the ground. This is due to the widespread and high volume use of chemicals, fertilizers and/or other contaminants on a golf course which provide the aesthetically pleasing appearance for the course and improved playing conditions.

Additionally, or in concert with the above, it is also desirable to elevate a golf club from the turf when playing so that the grip of the club remains dry, so as not hinder performance while playing. Further it is desirable to keep the golf grip free of the chemicals, fertilizers or contaminants so that contact with the golfer's skin is limited.

Even further, it is known that clubs such as chipping clubs or putters, for example, are used more than other clubs during a typical round of play because more strokes occur on or around the green than other times of play. It would be desirable to provide a structure for more easily accessing these clubs or otherwise separating these clubs for easier retrieval.

Given the foregoing, it would be desirable to provide a structure which addresses these and other deficiencies so that a golfer can more thoroughly enjoy a round of golf.

SUMMARY

A golf tool comprises a body having an upper portion and a lower portion, an outwardly facing surface and an inwardly facing surface, at least first and second prongs depending from the body for repairing a golf ball pitch-mark, an s-shaped serpentine structure extending from the upper portion of the body, the serpentine structure having a first end connected with and generally in vertical alignment with the body and a second end connected to a multi-purpose holder, the second end being offset from the body, the serpentine structure having a segment opposite the body defining a clip for clipping the golf tool to a golf bag, the multi-purpose holder having a shaft holder which is generally U-shaped and vertical in orientation, the multi-purpose holder separated from the body by the s-shaped serpentine structure, a channel having an axis which is generally horizontal and transverse to the shaft holder, wherein the golf tool is capable of a first position clipped to the golf bag and a golf shaft held in vertical orientation with the shaft holder, and a second position wherein the at least first and second prongs are positioned in the ground and a smoking article or golf club shaft is positioned in the channel to elevate from the ground. The golf tool wherein the body has a reinforcing rib. The golf tool wherein the reinforcing rib extending at least partially along the first and second prongs.

The golf tool wherein the reinforcing rib extends centrally along the body from the first and second prongs. The golf tool further comprising guide walls at an entry area to the U-shaped shaft holder. The golf tool wherein the channel is positioned across an upper end of the U-shaped shaft holder.

A golf tool comprises a body structure having a first end and a second end and an outward and inward facing surface, a pair of tines depending from the second end, each of the tines spaced from the other, a serpentine structure connected to the first end of the body, the serpentine structure being generally s-shaped, including a segment opposite the body defining a clip area, the clip area having an opening at lower end, said opening having a width which is less than a width at a closed end of said clip area, a multi-purpose holder spaced laterally from the body, the multi-purpose holder having a shaft holder which is oriented to retain a shaft vertically and is generally partially circular in cross-section, a transverse channel connected to the multi-purpose holder extending transverse to and intersecting the shaft holder at an upper end of the shaft holder, wherein an axis of the channel and an axis of the shaft holder are substantially perpendicular, wherein the opening is capable of receiving an edge of a golf bag so that a golf club shaft may be positioned in the shaft holder along an outside of the golf bag. The golf tool further comprising guide walls connected to the shaft holder. The golf tool wherein the guide walls are angled so that a first distance between the guide walls farther from the shaft holder is wider than a second distance between the guide walls closer to the shaft holder. The golf tool further comprising at least one stiffening rib. The golf tool wherein the at least one stiffening rib extends along the tines. The golf tool wherein the at least one stiffening rib extends along the body. The golf tool wherein a golf club shaft is positioned laterally offset from the tines. The golf tool holder further comprising a pocket which is disposed between the body and an intermediate segment.

A golf tool comprising a body having an inwardly facing surface and an outwardly facing surface and an upper end and a lower end, a first prong and a second prong depending from the body at an angle to the body, a serpentine structure having a first end and a second end, the first end connected to the upper end of the body and including a linearly extending segment opposite the inwardly facing surface of the body and defining a clip area, a multi-purpose holder connected to a second end of the serpentine structure, the multi-purpose holder having a channel extending across an upper end of the holder and having an axis which is generally perpendicular to the body, the multi-purpose holder further comprising a shaft holder extending generally perpendicular to the channel wherein an axis of the shaft holder intersects an axis of the channel and, the shaft holder having an opening, the opening facing away from the body. The golf tool further comprising guide walls extending from the opening of the shaft holder. The golf tool further comprising support surfaces defining the channel. The golf tool further comprising a frictional engagement rib extending from one of the body and the serpentine structure in the clip area. The golf tool further comprising a notch disposed in an upper surface of the serpentine structure. The golf tool wherein the prongs are thicker than the body in order to stiffen the tool.

A method of using a golf tool having a body, a plurality of prongs depending from the body, a multi-purpose holder connected by a serpentine structure to the body, the serpentine structure having a shaft holder and a channel extending across an upper end of the shaft holder, and a clip area defined by the body and the serpentine structure, the method comprising: placing the golf tool on an upper edge of a golf bag, sliding the golf tool downward so that the upper edge of the golf bag is received in the clip area, positioning a golf club shaft in the shaft holder, retaining the golf club along an outside of the bag.

A method of using a golf tool having a body, a plurality of prongs depending from said body, a multi-purpose holder connected by a serpentine structure to said body, said serpentine structure having a shaft holder and a channel extending across an upper end of said shaft holder, and a clip area defined by said body and said serpentine structure, the method comprising: placing a golf club in the shaft holder of the tool; placing the golf tool on an upper edge of a golf bag, sliding the golf tool downward so that the upper edge of the golf bag is received in the clip area for retaining a golf club along an outer surface of the golf bag.

BRIEF DESCRIPTION OF THE ILLUSTRATIONS

In order that the invention may be better understood, embodiments of the Golf Tool and methods of use thereof in accordance with the present invention will now be described by way of examples. These embodiments are not to limit the scope of the present invention as other embodiments of the Golf Tool will become apparent to one having ordinary skill in the art upon reading the instant description. Examples of the present invention are shown in figures wherein.

DETAILED DESCRIPTION

Figure 1:
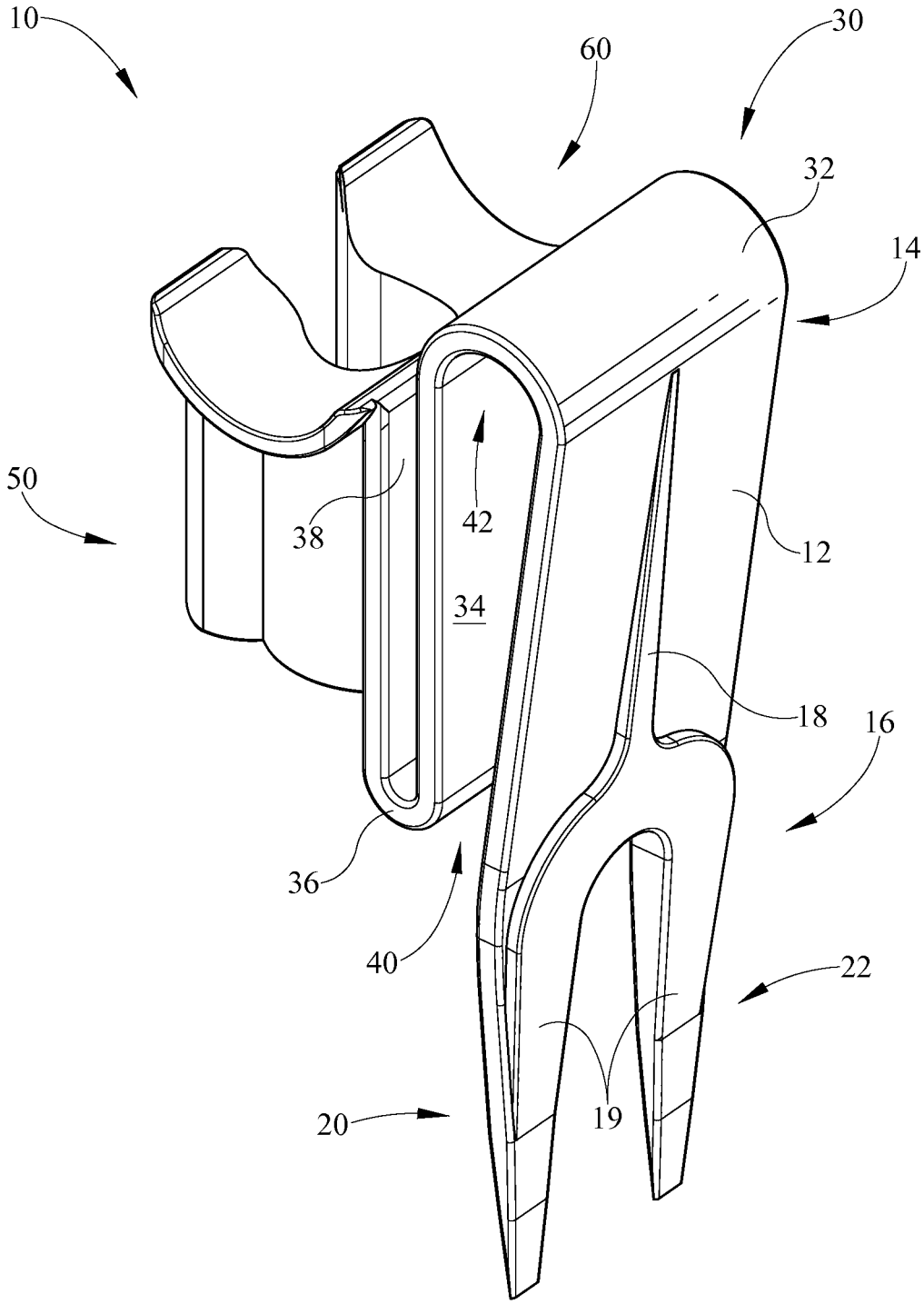
FIG. 1 is a first perspective view of an exemplary golf tool.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

As shown in the various FIGS. 1-7, a golf tool and method of use are shown. The golf tool may be used to repair pitch-marks, hold a golf club grip above damp turf, hold a smoking article above the turf, and hold a golf club on the outside of a golf bag when that golf club is used more frequently than other clubs. The term pitch-mark is also meant to refer to divots, a term which is sometimes incorrectly used to refer to marks caused by golf balls. The term turf is meant to refer to greens, aprons, or any area of ground or substrate, typically found on a golf course.

Referring now to FIG. 1, a golf tool 10 is depicted in perspective view. The golf tool is utilized to repair pitch-marks in a green or approach apron around a green. Additionally, the golf tool may be utilized to hold a smoking article such as a cigar or cigarette off of the turf to which is treated with chemicals on a regular basis and which may be harmful to humans. The golf tool additionally may be positioned within a golf bag partially to define a structure for holding a golf club outside of the golf bag in a vertical orientation. This allows for ease of access for a club which is used on a more regular basis, such as a putter, chipping club or driver.

The golf tool 10 includes a body 12. The body has a first upper end 14 and a second lower end 16 and includes opposed surfaces extending between the upper and lower ends 14, 16. The body 12 has a thickness which provides some level of stiffness for the golf tool 10. The golf tool 10 may be formed of various materials, such as lightweight metallic or lightweight plastimerics and polymerics which additionally provide some level of stiffness but are not so rigid as to break during normal use. Extending vertically along the body 12 is a rib 18. The rib additionally provides some stiffening for the body.

Depending downwardly from the second end 16 of the body 12 are first and second prongs or tines 20, 22. These structures are utilized to be positioned about a golf ball pitch-mark and urge the material back to its position prior to receiving the golf ball from the air. At the second end 16 of the body 12, the prongs 20, 22 are thicker than at the lowermost end. The taper of the prongs 20, 22 allows for easier insertion of these elements into the green or apron area to repair a pitch-mark. The lowermost ends of these prongs are defined by flat edges however, these lowermost ends may also be curved or rounded. Also, referring to FIG. 3 briefly, the prongs 20, 22 are positioned at an angle relative to the vertical or alternatively, the prongs 20, 22 are at an angle to the body 12. The at least one rib 18 extends to the prongs 20, 22 and extends along at least inward edges of the prongs providing some level of stiffening of the prongs and inhibiting breakage during use of the pitch-mark repair portion of the tool. In the exemplary embodiment, the ribs 19 extend across the entire surface area of the prongs 20, 22. The lower portion 16 of the body has a curvature disposed between the upper ends of the prongs 20, 22. The rib 18 extends to this curve and to ribs 19 extend along the prongs 20, 22 to provide this stiffening. The ribs 18, 19 are shown as integrally formed however, these ribs may also be independently formed as well.

At the upper end 14 of the body 12 a serpentine structure 30 is connected to the body 12. The serpentine structure is generally S-shaped having a first curved segment 32 connected to the upper end 14. The first curved segment is generally U-shaped and extends about a horizontal axis about one hundred and eighty degrees. A middle segment extends from the first curved segment 32 to a second curved segment 36. The second curved segment connects to the lower end of the intermediate segment 34 and curves turning upwardly to its upper end 38.

Between its second curved segment 36 and the body 12 is an opening 40 which extends upwardly toward the first curved segment 32 which defines a closed end 42. A slot is defined between the opening 40 and the closed end 42 as well as between the intermediate segment 34 and the body 12. Referring briefly again to FIG. 3, the body 12 is shown at an angle to the vertical and the intermediate segment 34 is shown in vertical orientation. This provides that the opening 40 has a width which is less than the width between the upper end 14 and the opposite side of the first curved segment 32. Within this area and via the opening 40, the tool may be placed along the uppermost edge of a golf bag so that a golf club may be held on the outside of a club for easy access and increased usage as opposed to other clubs. For example, a highly used club could be a driver, putter or wedge for chipping. The opening 40 being of a small width than at the closed end allows positioning of the bag upper edge there through to allow placement of the prongs 20, 22 downwardly into the bag and so that the multi-purpose holder 50 is positioned outside the bag.

Figure 2:
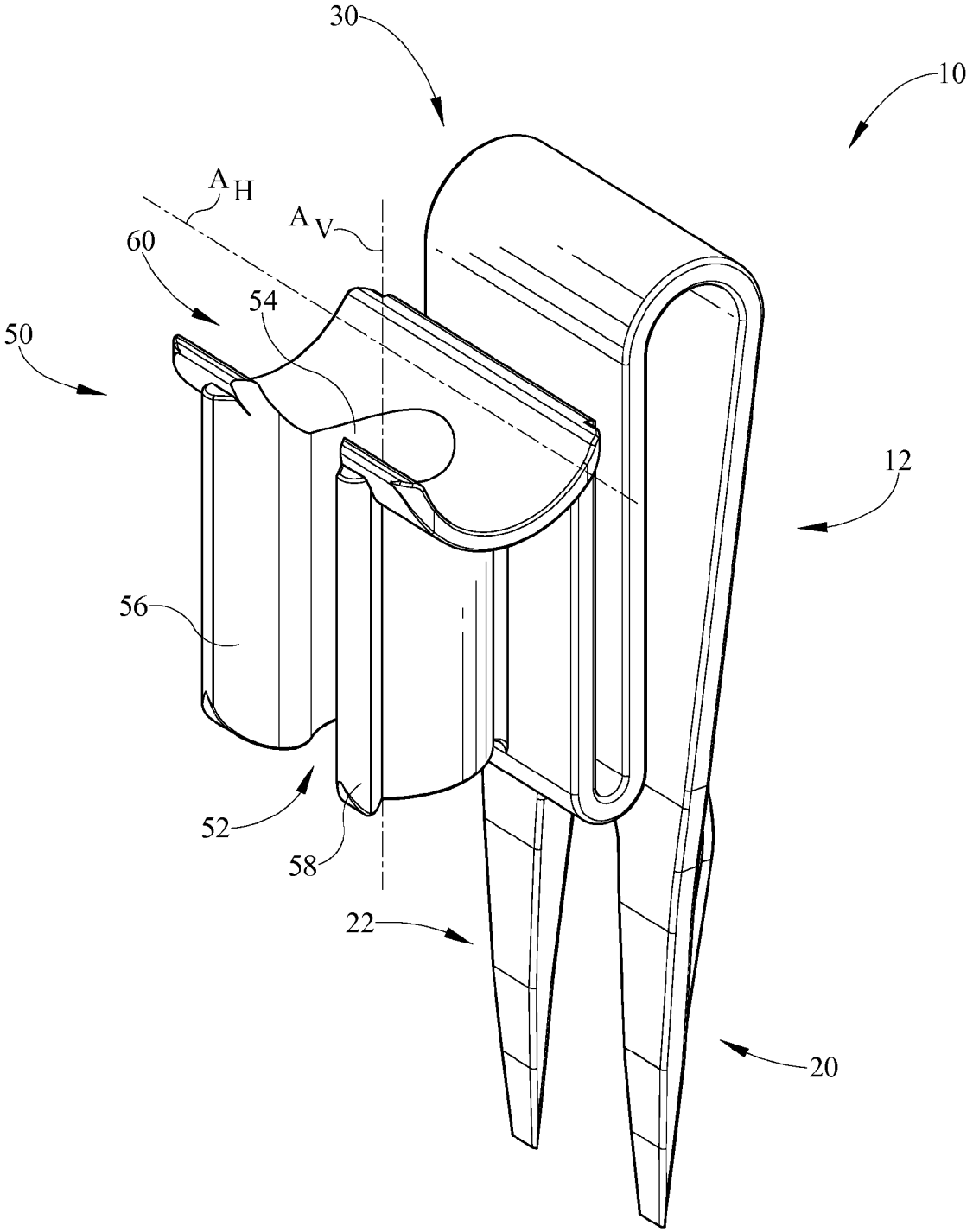
FIG. 2 is a second perspective view of an exemplary golf tool rotated about a vertical axis from the view of FIG. 1.

Referring now to FIG. 2, the golf tool 10 is shown in perspective view rotated about a vertical axis relative to FIG. 1. In this view, the multi-purpose holder 50 is shown more clearly. The multi-purpose holder 50 includes a vertically orientated shaft holder 52. The orientation of the shaft holder 52 is vertical due to the positioning of the golf tool 10 as shown in the view. However, the shaft orientation may alternatively be at some angle to the vertical if the tool is utilized on a stand bag which may be oriented at an angle to the vertical as well. This will be understood and described further herein. The shaft holder 52 is defined by a generally C or U-shaped structure having a partially circular cross-section. The shaft holder 52 is defined by a curved wall 54 having an opening directed away from the body 12. The wall 54 extends vertically and is offset from prongs 20, 22 and body 12. Extending from the open portion of the shaft holder 52 are guide walls 56, 58. These guide walls 56, 58 are angled so as to accept a golf club shaft and guide the shaft into the opening defined by the shaft holder 52. This will hold a golf club shaft in an orientation that is generally aligned relative to the vertical with the golf tool 10. The wall 54 may be of constant radius or may be tapered to aid in receiving and holding a golf club shaft.

Extending across the upper end of the shaft holder 52 is a channel 60. The channel is curved about a horizontal axis and is utilized to receive a smoking article such as a cigar or cigarette. The channel 60 has a generally half-cylinder shape and may be utilized when the prongs 20, 22 are positioned into the ground so as to elevate the smoking article off of the ground. The wall 54 supports the channel 60 from below to limit flexing of the tool when a golf club shaft is placed across the channel 60.

The channel 60 and shaft holder 52 each comprise an axis defined in the figure as $A_H$ and $A_V$, respectively. The channel 60 has a horizontal axis and the shaft holder 52 has a vertical axis. These axes are generally perpendicular to one another and may also be aligned so as to intersect one another. The multi-purpose holder 50 may include a magnetic element or may be formed of a magnetic material which is attached to the body 12. The magnetic material may be utilized to aid in retaining the golf club in the various areas of the multi-purpose holder 50 without dropping the club.

Along a rear portion of the multi-purpose holder 50 is a connection or rib for connection with the serpentine structure 30. This structure may have some resilience allowing a minimal amount of flexibility and movement to inhibit breakage which may occur if the structure is openly rigid. Since the golf tool 10 may be integrally formed or may be a molded article, the material resilience may be similar to that of the tool as a whole.

Figure 3:
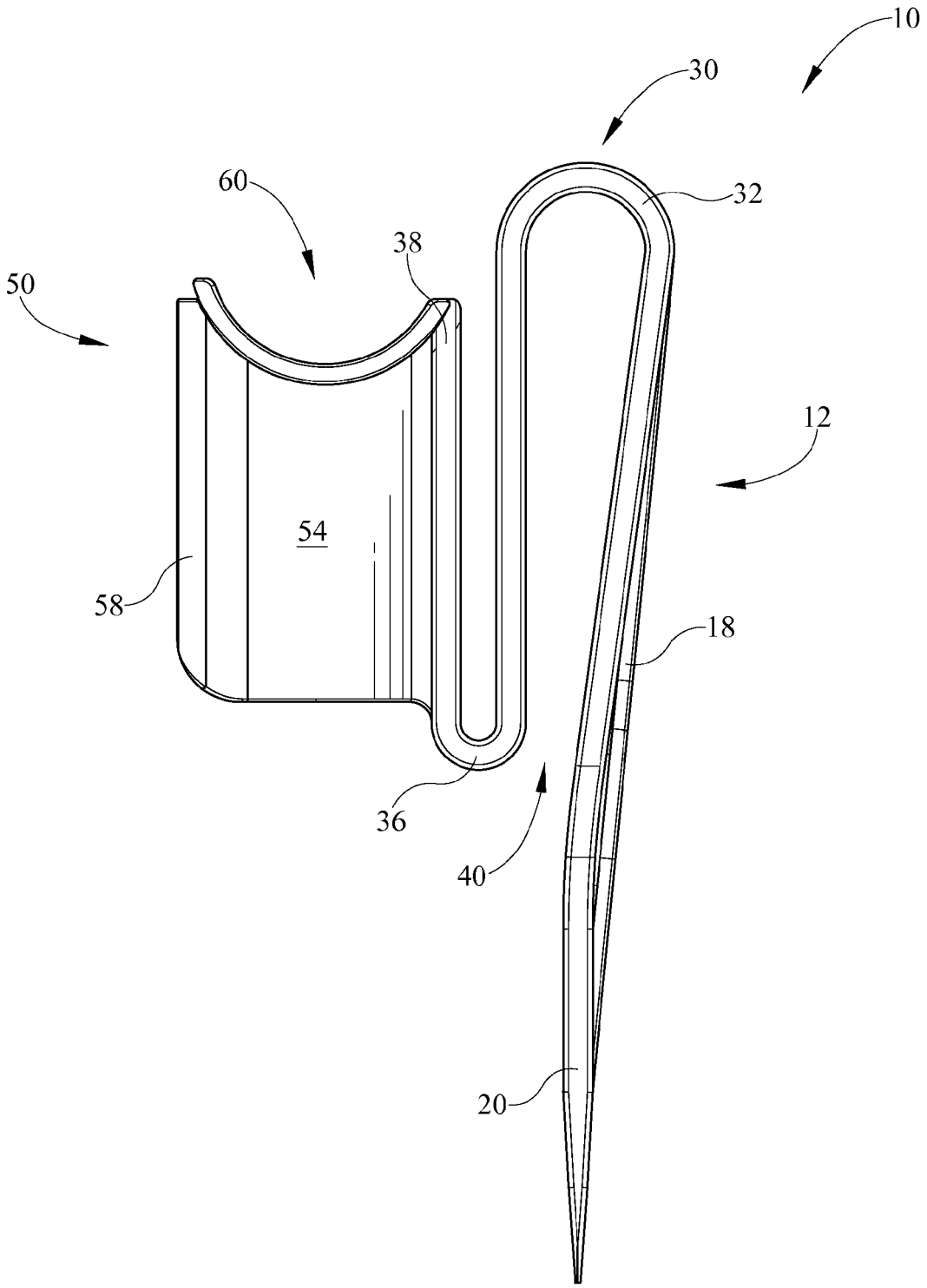
FIG. 3 is a side view of the exemplary golf tool.

Referring now to FIG. 3, a side view of the golf tool 10 is shown. As best shown in this view, the multi-purpose holder 50 is laterally spaced from the body 12. The offset is provided by the serpentine structure 30. In this view, the serpentine structure 30 is shown clearly to have two curved ends which provides some amount of resilience and limited flexibility. The shaft holder 52 when receiving a golf club shaft may flex toward the body 12 due to the weight of the club. More specifically, the lower end of the intermediate segment 34 may move toward the body 12. This may provide some grip on the outside of a golf bag, upon which the tool 10 may be clipped.

As related to the golf bag, the edge of the bag is received in the tool 10. An edge of the bag may be received between the body 12 and the intermediate segment 34. The edge of the bag is moved upwardly through this pocket portion of the tool 10 until engaging an inner surface of the first curved segment 32. This provides a structure for supporting the tool 10 on the golf bag and retaining a golf club in the tool 10 on the outside of the bag. As an alternative, the tool 10 may receive a belt or edge of a pocket for ease of storage and/or use by a user.

Figure 4:
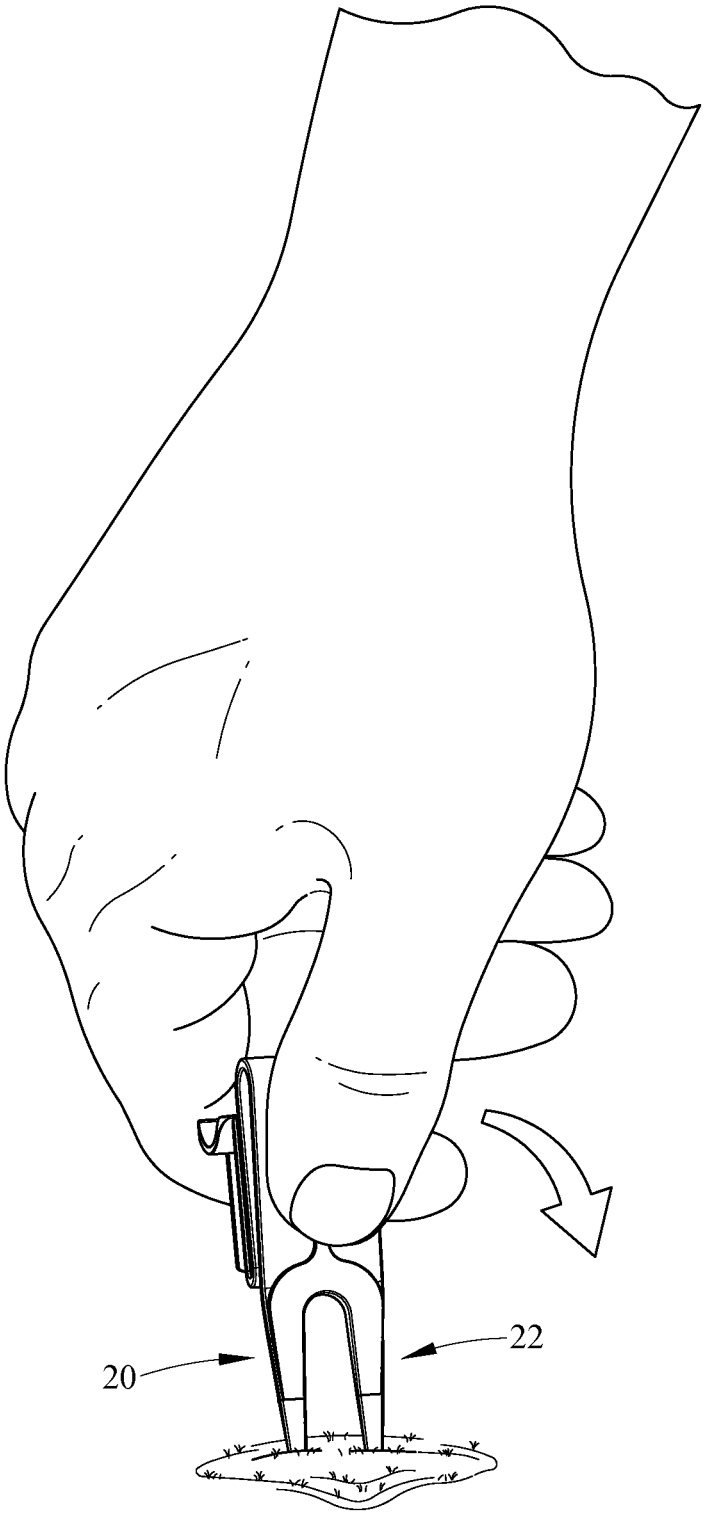
FIG. 4 is a perspective view of the tool in use to repair a pitch-mark.

The flexibility of the serpentine structure 30 also provides that the tool 10 does not break when using the tool for pitch-mark repair. Use of the tool 10 for pitch-mark repair places a force on the tool in a direction either perpendicular to or at least at some angle to the linear extending direction of the body 12 and prongs 20, 22 as shown in FIG. 4 by the force arrow). However, a stiff, rigid connection between the body 12 and the multi-purpose holder 50 may result in a fracture of the tool at the connection between the multi-purpose holder 50 and the body 12. However the flexibility provided by the multi-purpose tool holder 50 inhibits breakage of the tool. Thus the lateral offset of the holder 50 from the body 12 and prongs 20, 22 provides an advantage to the use of this tool not heretofore found in prior art devices. It allows for some flexibility in the tool as well as allowing clipping of the tool to a golf bag. This clipping function provides two advantages: (1) ease of removal of the tool and (2) a place to hold or retain a golf club along the outside of the golf bag.

The prongs 20, 22 are disposed at an angle to the body 12. The angle allows improved repair of the turf during repair of pitch-marks. Additionally, the angle of the prongs 20, 22 also aids repair of turf without interference between the holder 50 and the turf adjacent the area being repaired. In other words, the angle between the prongs 20, 22 and the body 12 creates some amount of clearance between the holder 50 and the turf, by effectively raising the holder 50 by an amount related to the angle.

Referring now to FIG. 4, a perspective view of the tool is shown being used to repair a pitch-mark. The tool is placed in the turf in or around the perimeter of a pitch-mark where a golf ball has landed on a green surface or an apron surface. The prongs 20, 22 are inserted in the turf and leveraged by applying force on the body 12 or on the multi-purpose holder 50 so as to pull or push the depressed turf up and toward the central portion of the pitch-mark. This effectively closes the "opening" or pitch-mark in the green. This action is completed at multiple positions around the perimeter of the pitch-mark.

According to a second method, with the prongs 20, 22 inserted in the turf along the perimeter of the pitch-mark, the tool 10 may be rotated up to about 90 degrees in order to pull the turf from the perimeter of the pitch-mark to the central area of the pitch-mark and effectively return the displaced turf to its original position. Like the first method, this twisting technique occurs about the perimeter of the pitch-mark at various locations until the pitch-mark is fully repaired. In utilizing this second method, the multi-purpose holder 50 allows for application of added torque to the prongs 20, 22 due to the lateral offset of the holder 50 from the body 12.

Figure 5:
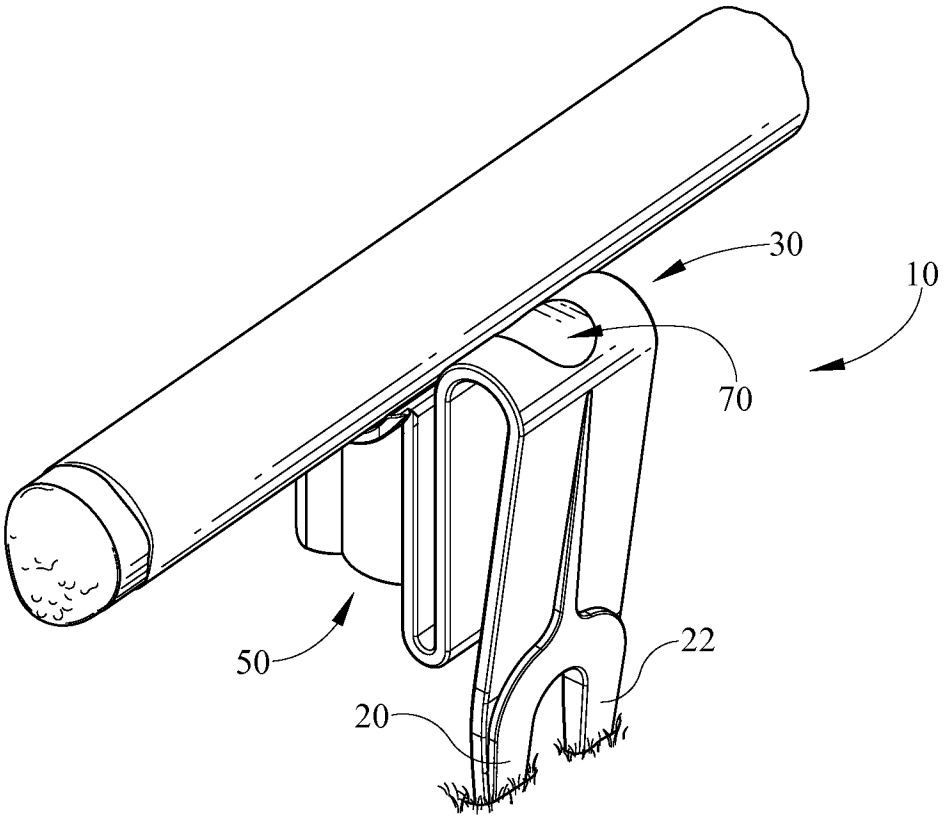
FIG. 5 is a perspective view of the tool being used to hold a smoking article.

Referring now to FIG. 5, a perspective view of the tool 10 is shown holding a smoking article. The article may be a cigarette, a cigar or other article as one skilled in the art will understand. The purpose of the tool 10 in this orientation is to hold the smoking article spaced from the ground. Golf courses are known to use fertilizers and chemicals, the long term effects of which on human beings are unknown. Without a tool to hold the smoking article above the turf, the smoking article maybe placed on the ground and subsequent placement of the article in the user's mouth results in transfer of those fertilizers and chemicals to the user's mouth and potentially bloodstream. The tool 10 holds the smoking article off of the turf so that the article does not touch the turf and the chemicals and contaminants from the golf course turf are not transferred to the user.

Still referring to FIG. 5, the exemplary golf tool 10 includes a notch 70. When the channel 60 is utilized by smoking article, the notch 70 serves as an alternate location wherein a golf club shaft or grip may be positioned, transverse to the channel 60, in order to elevate the golf grip above the turf. As a result, the golf club may also serve to retain the smoking article in position, for example on extremely windy days where the article might otherwise be blown out. However, the tool 10 may be used in a similar manner without the notch 70. The notch 70 merely serves to aid positioning of the golf club and inhibiting slippage from the upper surface of curved segment 32.

Figure 6:
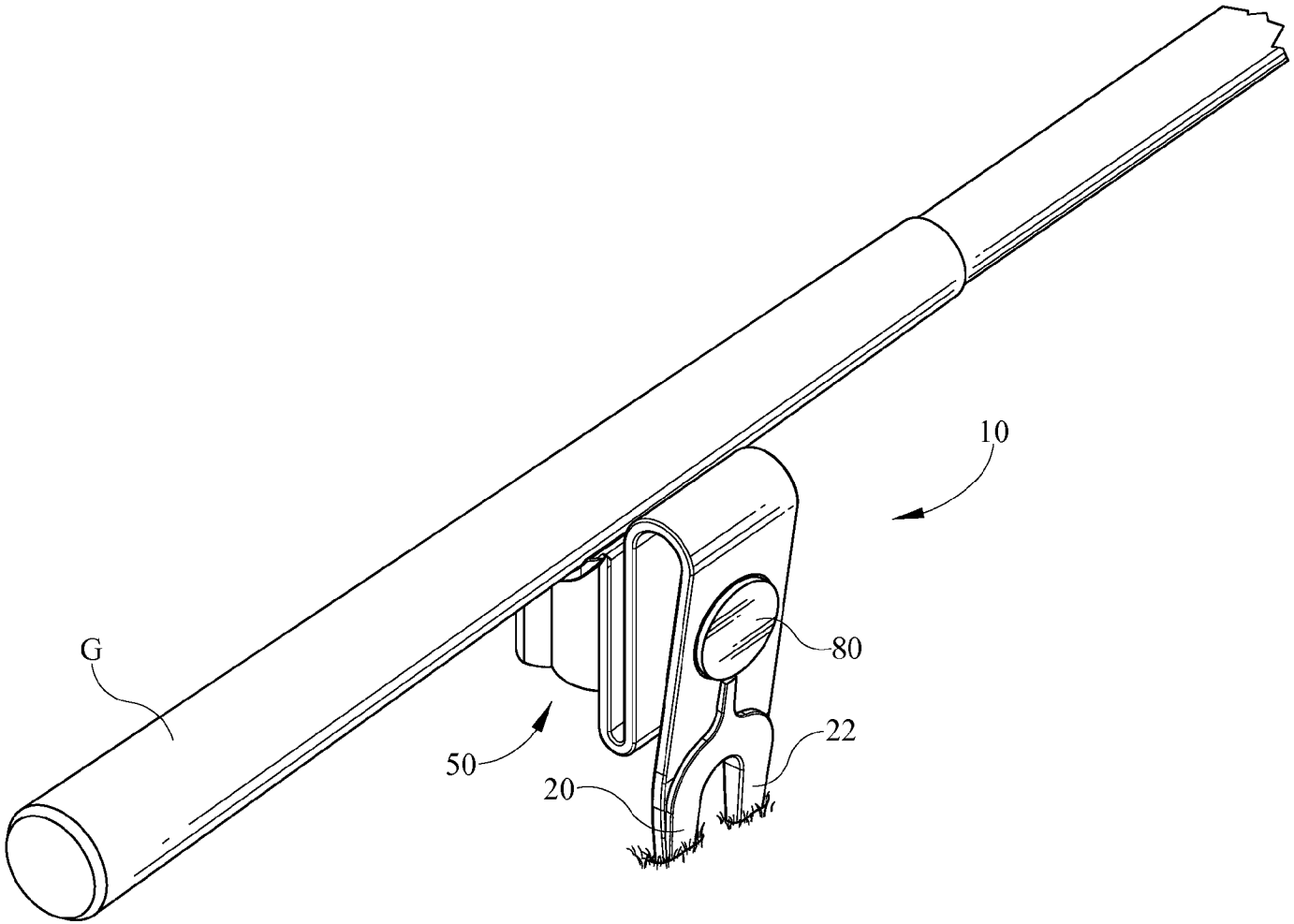
FIG. 6 is a perspective view of the exemplary golf tool holding a club off of the ground; and, FIG. 7 is a perspective view of the exemplary golf tool holding a club in a bag.

Referring now to FIG. 6, a perspective view of the tool 10 is shown holding the golf club grip above the turf. One annoying situation which occurs during a round of golf is when golf club grips get wet. This can occur when turf is wet not only from rain but also when dew is on the turf during morning play. In order to inhibit saturation of the golf club grips, it is desirable to elevate those grips from the turf. Additionally, it is desirable to inhibit transfer of chemicals and fertilizer from the turf onto the grips and subsequently on the user's hands.

As shown in FIG. 6, the tool 10 may be placed into the turf and the channel 60 utilized to elevate at least the grip end of the golf club off of the turf. The golf club may be balanced in the channel 60 so as to elevate the club or may be rested in a non-balanced condition so that the club head rests on the ground and the grip end of the club is elevated. As an alternative, the golf club may be rested on the first curved segment 32 to elevate the grip end of the club, if a smoking article is disposed in the channel 60 when the grip elevation functionality it utilized. As a result, an alternative embodiment may also have a small notch in the first curved segment 32 to retain the club in the tool 10, as shown in broken line.

Referring still to FIG. 6, an additional alternative component is depicted. The tool 10 is shown with a marker 80. If the tool 10 is metallic, the tool may be magnetized and the marker used with the tool 10 in that manner. However, if the tool 10 is formed of a plastic material, a magnetic element may be positioned within the tool 10 by means of an adhesive and the marker retained on the magnet by the attractive force therebetween. The marker 80 allows the user to mark his golf ball with a preferably circular marker as called for by the rules of golf.

Figure 7:
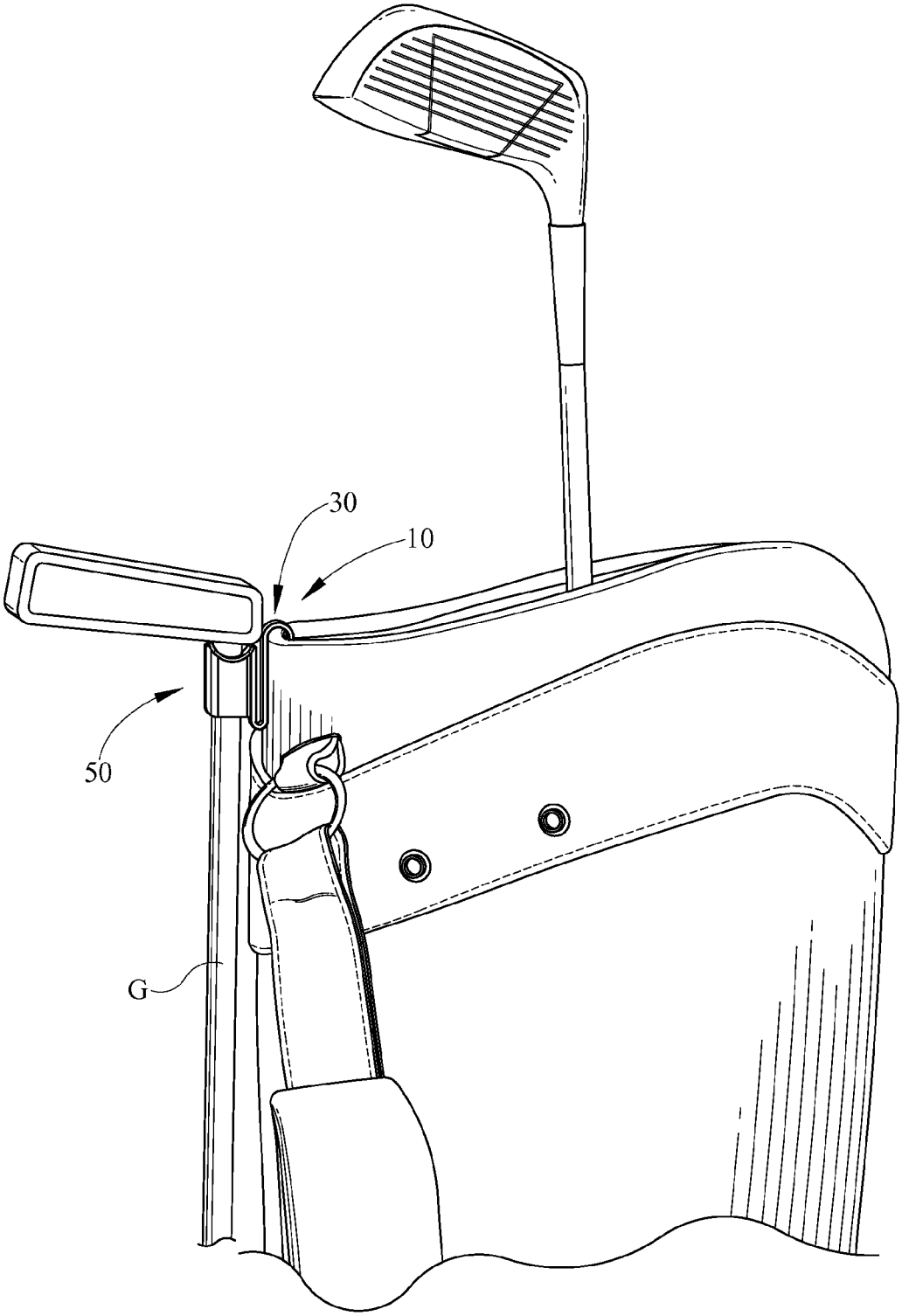

Referring now to FIG. 7, the golf tool 10 is shown disposed on a golf bag. A perimeter of the golf bag is received between the body 12 and the intermediate segment 34 in order to capture the tool on the bag. The holder 50 is disposed on the outside of the bag so that a golf club may be positioned into the shaft holder 52. It should be understood that the orientation of the golf bag may dictate the orientation of the holder 52 and club shaft. For example, if a golf bag is disposed in a golf cart, the bag will be vertical and therefore the shaft holder 52 will likely be vertical, assuming a horizontal rim on the golf bag. If the golf bag is a stand bag and the stand or legs are deployed, the shaft holder 52 will likely be at an angle assumed by the bag. In either event, the tool 10 will hold a golf club on the outside of the bag. This is especially handy for clubs which are used more readily than others such as for putting or chipping. However, the functionality is not limited to these clubs as other clubs may be retained by the tool 10.

The foregoing description of several embodiments and methods of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A golf tool, comprising:

a body having an upper portion and a lower portion, an outwardly facing surface and an inwardly facing surface;

at least first and second prongs depending from said body for repairing a golf ball pitch-mark;

an s-shaped serpentine structure extending from said upper portion of said body, said serpentine structure having a first end connected with and generally in vertical alignment with said body and a second end connected to a multi-purpose holder, said second end being offset from said body, said serpentine structure having a segment opposite said body defining a clip for clipping said golf tool to a golf bag;

said multi-purpose holder having a shaft holder which is generally U-shaped and vertical in orientation, said multi-purpose holder separated from said body by said s-shaped serpentine structure;

a channel having an axis which is generally horizontal and transverse to said shaft holder;

wherein said golf tool is capable of a first position clipped to said golf bag and a golf shaft held in vertical orientation with said shaft holder, and a second position wherein said at least first and second prongs are positioned in the ground and a smoking article or golf club shaft is positioned in said channel to elevate from the ground.

2. The golf tool of claim 1, said body having a reinforcing rib.

3. The golf tool of claim 1, said reinforcing rib extending at least partially along said first and second prongs.

4. The golf tool of claim 3, said reinforcing rib extending centrally along said body from said first and second prongs.

5. The golf tool of claim 1 further comprising guide walls at an entry area to said U-shaped shaft holder.

6. The golf tool of claim 1, said channel positioned across an upper end of said U-shaped shaft holder.

7. A golf tool, comprising:

a body structure having a first end and a second end and an outward and inward facing surface;

a pair of tines depending from said second end, each of said tines spaced from the other;

a serpentine structure connected to said first end of said body, said serpentine structure being generally s-shaped, including a segment opposite said body defining a clip area, said clip area having an opening at lower end, said opening having a width which is less than a width at a closed end of said clip area;

a multi-purpose holder spaced laterally from said body, said multi-purpose holder having a shaft holder which is oriented to retain a shaft vertically and is generally partially circular in cross-section;

a transverse channel connected to said multi-purpose holder extending transverse to and intersecting said shaft holder at an upper end of said shaft holder, wherein an axis of said channel and an axis of said shaft holder are substantially perpendicular;

wherein said opening is capable of receiving an edge of a golf bag so that a golf club shaft may be positioned in said shaft holder along an outside of said golf bag.

8. The golf tool of claim 7 further comprising guide walls connected to said shaft holder.

9. The golf tool holder of claim 8, said guide walls being angled so that a first distance between said guide walls farther from said shaft holder is wider than a second distance between said guide walls closer to said shaft holder.

10. The golf tool holder of claim 7 further comprising at least one stiffening rib.

11. The golf tool holder of claim 10, said at least one stiffening rib extending along said tines.

12. The golf tool holder of claim 10, said at least one stiffening rib extending along said body.

13. The golf tool holder of claim 7 wherein a golf club shaft is positioned laterally offset from said tines.

14. The golf tool holder of claim 7 further comprising a pocket which is disposed between said body and an intermediate segment.

15. A golf tool, comprising:

a body having an inwardly facing surface and an outwardly facing surface and an upper end and a lower end;

a first prong and a second prong depending from said body at an angle to said body;

a serpentine structure having a first end and a second end, said first end connected to said upper end of said body and including a linearly extending segment opposite said inwardly facing surface of said body and defining a clip area;

a multi-purpose holder connected to a second end of said serpentine structure, said multi-purpose holder having a channel extending across an upper end of said holder and having an axis which is generally perpendicular to said body, said multi-purpose holder further comprising a shaft holder extending generally perpendicular to said channel wherein an axis of said shaft holder intersects an axis of said channel; and, said shaft holder having an opening, said opening facing away from said body.

16. The golf tool of claim 15 further comprising guide walls extending from said opening of said shaft holder.

17. The golf tool of claim 15 further comprising support surfaces defining said channel.

18. The golf tool of claim 15 further comprising a frictional engagement rib extending from one of said body and said serpentine structure in said clip area.

19. The golf tool of claim 15 further comprising a notch disposed in an upper surface of said serpentine structure.

20. The golf tool of claim 15, said prongs being thicker than said body in order to stiffen said tool.

* * * * *